US007594417B1

(12) United States Patent
Ghiran et al.

(10) Patent No.: US 7,594,417 B1
(45) Date of Patent: Sep. 29, 2009

(54) APPARATUS FOR WIPER DIE MONITORING

(75) Inventors: Mike M. Ghiran, Lake Orion, MI (US); Spyros P. Mellas, Waterford, MI (US); William M. Crantas, Highland, MI (US); Kevin R. Marks, Durand, MI (US); Douglas T. Wohlenhaus, Flushing, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/192,191

(22) Filed: Aug. 15, 2008

(51) Int. Cl.
*B21D 7/04* (2006.01)

(52) U.S. Cl. ..... 72/21.4; 72/19.8; 72/20.1; 72/149; 72/150; 72/369; 72/370.1

(58) Field of Classification Search ..... 72/17.2, 72/19.8, 20.1, 21.4, 129, 149, 150, 153, 154, 72/155, 157, 158, 294, 307, 369, 370.01
See application file for complete search history.

(56) References Cited

U.S. PATENT DOCUMENTS 4,959,984 A * 10/1990 Trudell et al. ..... 72/150
5,819,574 A * 10/1998 Yogo ..... 72/20.1
6,820,450 B2 11/2004 Yamada et al.
7,059,033 B2 6/2006 Bruggemann
7,140,224 B2 11/2006 Luo et al.
7,159,430 B2 * 1/2007 Yogo ..... 72/149

OTHER PUBLICATIONS

Corner Rosette Strain Gage product sheet of Omega Engineering, Inc., Stamford, CT, published at website: www.omega.com, copyright date on website: 2003-2008.
Strain Gage Bridge product sheet of Omega Engineering, Inc., Stamford, CT, published at website: www.omega.com, copyright date on website: 2003-2008.
Pre-Wired Strain Gage product sheet of Omega Engineering, Inc., Stamford, CT, published at website: www.omega.com, copyright date on website: 2003-2008.
Tactilus Force Indicating Washer product sheets (2 pgs) of Sensor Products, inc. of Madison, NJ, published at website: www.sensorprod.com, copyright dated 2008.
Tactile Pressure Indicating Sensor Film product sheets (2 pgs) of Sensor Products, inc. of Madison, NJ, published at website: www.sensorprod.com, copyright dated 2008.
Tactilus Printed Circuit Boards product sheet of Sensor Products, inc. of Madison, NJ, published at website: www.sensorprod.com, copyright dated 2006.
Tactile Pressure Indicating Sensor Film product sheets (2 pgs) of Sensor Products, inc. of Madison, NJ, published at website: www.sensorprod.com, copyright dated 2008.

(Continued)

*Primary Examiner*—David B Jones

(57) ABSTRACT

In a rotary tube bender, a first set of pressure sensors is located between the normally disposed mating surfaces of a wiper die insert and its wiper die holder; and a second set of pressure sensors is located between the axially disposed surfaces of the wiper die insert and the wiper die holder. Signal outputs of the first and second sets of pressure sensors over the course of bending cycles are compared to previously determined nominal signal outputs for drift indicative of whether a realignment or replacement of the wiper die should be performed.

12 Claims, 8 Drawing Sheets

OTHER PUBLICATIONS

Tactile Sensor product sheet of Pressure profile Systems, Inc. of Los Angeles, CA, published at website: www.pressureprofile.com copyright dated 2007.

Array Sensors product sheets (2 pgs) of Tactex Controls, Inc. of Victoria, British Columbia, Canada, published at website: www.tectex.com copyright 2007.

FlexiForce (registered TM) Force Sensors product sheets of Tekscan, Inc. of South Boston, MA, published at website: www.tekscan.com, copyright date on website 2007.

Mike M. Ghiran et al., U.S. Appl. No. 11/971,989, filed Jan. 10, 2008, "Bending Apparatus and Method of Bending a Metal Object", assigned to GM Global Technology Operations, Inc.

* cited by examiner

APPARATUS FOR WIPER DIE MONITORING

TECHNICAL FIELD

The present invention relates, in general, to dies used in the bending of tubular workpieces. More particularly, the present invention relates to an apparatus, and methodology of use therefor, for monitoring of the location and applied pressure characteristics of a wiper die insert of a rotary tube bender.

BACKGROUND OF THE INVENTION

The process of hydroforming is a metal forming process whereby specialized dies are used in conjunction with high pressure hydraulic fluid to force room temperature metal into the dies to form parts. An important application of hydroforming as used in the automotive industry is the creation of bent tubular parts. Many automotive bent tubular parts are produced utilizing a rotary tube bender, most commonly in the form of a "horizontal rotary draw bender".

FIGS. 1 through 3 schematically depict a rotary tube bender in the form of a horizontal rotary draw bender 10, as known in the art, which includes a set of four dies: a bend die 12, a clamp die 14, a pressure die 16, and a wiper die 18. The bend die 12 is mounted to a stationary base 20, and is a forming tool designed to produce a particular radius of bend in the tubular workpiece 22 to be bent (compare FIGS. 1 and 3) per a concave radius 12*a*. The clamp die 14 is a tool designed to close securely upon the tubular workpiece 22. The pressure die 16 is used to press the tubular workpiece 22 into the bend die 12 via the wiper die 18, wherein the wiper die is a tool having a predefined curvilinear edge (see FIG. 4) which is shaped to abut the concave radius 12*a* of the bend die 12. The pressure die may also have a delayed (to avoid collision with the clamp die) "boost" or axial assist to push the tube forward during bending, which will feed material preventing a failure or rupture of the tube during the bending operation. The wiper die 18 is designed to prevent the formation of wrinkles or ridges in the tubular workpiece 22 during the process of its bending by the horizontal rotary draw bender 10, wherein an electronically controlled hydraulic rotation apparatus (not shown) is connected with the clamp die 14.

In this regard, FIG. 3 depicts the operation of the horizontal rotary draw bender 10 with respect to the bending of the tubular workpiece 22, which is inserted between the pressure die 16 and the wiper die 18 in interfacing relation with the bend die 12. The clamping pressure and rotation of the clamp die 14, while the pressure die 16 exerts pressure toward the wiper die 18 and bend die 12 and moves linearly forward toward clamp die 14 to prevent unnecessary elongation or tube failure, as provided by the hydraulic rotary apparatus, results in a bend 22*a* of the tubular workpiece 22 which conforms to the concave radius 12*a* (see FIG. 2) of the bend die 12. The wiper die 18 plays a significant role in the bending process of the tubular workpiece, whereby the wiper die ensures that no wrinkles will be produced while bending the workpiece, particularly at the inner radius of the bend.

As can be seen from FIGS. 4 through 5B, the wiper die 18 is composed of a wiper die holder 24 and a wiper die insert 26, which have mutually mating surfaces: a concave holder mating surface 24*a* and a convex insert mating surface 26*a*, which mating surfaces are complementing with respect to each other. The holder mating surface 24*a* has a raised boss 28 which is received by a complementary keyway (i.e., slot) 30 formed in the insert mating surface 26*a*. The wiper die 18 has a workpiece seating surface 34 having a concave radius for seating the convex outer surface of the tubular workpiece 22, wherein, in this respect, the wiper die holder has a holder workpiece seating surface 34*a*, and the wiper die insert has an insert workpiece seating surface 34*b*. The wiper die insert 26 is affixed to the wiper die holder 24 via, for example, a threaded fastener (not shown) threading at a bore 36 in the wiper die holder and the wiper die insert, wherein the bore is threaded at the wiper die insert portion thereof. At the distal end of the insert workpiece seating surface 34*b* is an insert edge 32 of the wiper die insert 26 which is of critical importance in the quality of the bend of the workpiece, via careful adjustment of the interface of the insert edge with respect to each of the bend die and the workpiece.

The insert edge 32 is the principal location of wear and its location is critical. In low volume production, a skilled operator can visibly detect when the wiper die insert 26 has become unsuitable to the point of needing replacement or adjustment. In a high volume setting, however, the traditional method of waiting for the workpieces to show evidence of this wear is inadequate.

Accordingly, what remains needed in the art is a means to monitor the location of the wiper die in the course of workpiece bending so that once the wiper die insert thereof has become unsuitable for production of bent tubular articles of sufficient quality, the operator will quickly and easily be enabled to detect this condition and render appropriate remedy.

SUMMARY OF THE INVENTION

The present invention provides sensors for monitoring a plurality of normal and axial pressures of the wiper die insert with respect to the wiper die holder, whereby the operator is enabled to quickly and easily detect when the wiper die insert is no longer able to provide bent tubular articles of sufficient quality.

In order for the wiper die to perform its function, it must hold a firm abutting relation simultaneously to both the convex outer surface of the workpiece and concave radius of the bend die, and in so doing maintain an optimum fore-aft location and optimum angular orientation, referred to in the art as the "rake angle", and in addition, the wiper die must be provided an optimum force (or pressure) distribution from the pressure die. Three location parameters of the wiper die insert with respect to the wiper die holder are important to monitor location/pressure variation of the wiper die insert vis-à-vis whether the wiper die insert is in condition to provide quality bending of tubular workpieces: 1) the normal force distribution of the pressure die as realized between the mating surfaces of the wiper die holder and wiper die insert; 2) the rake angle, which is the angle that the entire wiper die and wiper die holder is offset or pivoted from the center line of the tubular workpiece at the point of contact between the wiper die and the bend die, wherein the rake angle places either more or less of the wiper die surface in contact with the tubular workpiece during bending, which affects the frictional forces acting on the workpiece tube and prevents wrinkling on the compression side of the bend; and 3) the fore aft location as between the wiper die insert and the wiper die holder. The present invention enables the operator to continually monitor these three sources of location/pressure variation of the wiper die insert via a pressure sensing wiper die.

The pressure sensing wiper die according to the present invention has a first set of pressure sensors placed on a normally disposed mating surface of either the wiper die insert or the wiper die holder so as to be in pressing normal abutment with the other complementing mating surface of the wiper die. The pressure sensors of the first set of pressure sensors are distributed so as to register pressures at strategic locations of the abutting interface between the wiper die insert and the wiper die holder mating surfaces, whereby the operator is enabled to evaluate the normal forces acting on the wiper die during bending operations.

The pressure sensing wiper die according to the present invention further has a second set of pressure sensors placed at an axially disposed mutually abutting surface interface between the wiper die insert and the wiper die holder. The pressure sensors of the second set of pressure sensors are distributed so as to register pressures at strategic locations of the abutting axial interface between the wiper die insert and the wiper die holder axial surfaces, whereby the operator is enabled to evaluate the axial forces acting on the wiper die during bending operations.

In operation, the wiper die insert is first affixed to the wiper die holder and the wiper die is located such that the wiper die insert has an optimal rake angle, optimal fore-aft location, and optimal normal pressure distribution when performing a bending operation on a tubular workpiece. Initial, or nominal, signal outputs of the first and second set of sensors during at least one bending operation are then stored. The operator will thereafter monitor the signal outputs of the first and second sets of pressure sensors over the course of future bending cycles for comparative signal outputs drift from the nominal signal outputs (having correlation to location variation of the wiper die insert with respect to the wiper die holder), wherein a signal outputs drift indicative of the need of realignment or replacement of the wiper die inset can be discerned before tubular workpieces being bent can be adversely affected thereby.

Accordingly, it is an object of the present invention to provide a means to detect when the wiper die insert is approaching a condition in which it will no longer produce bent tubular workpieces of sufficient quality by monitoring drift of normal and axial pressure distributions of the wiper die insert with respect to the wiper die holder from nominal values.

This and additional objects, features and advantages of the present invention will become clearer from the following specification of a preferred embodiment.

DESCRIPTION OF THE PREFERRED EMBODIMENT

Figure 1:
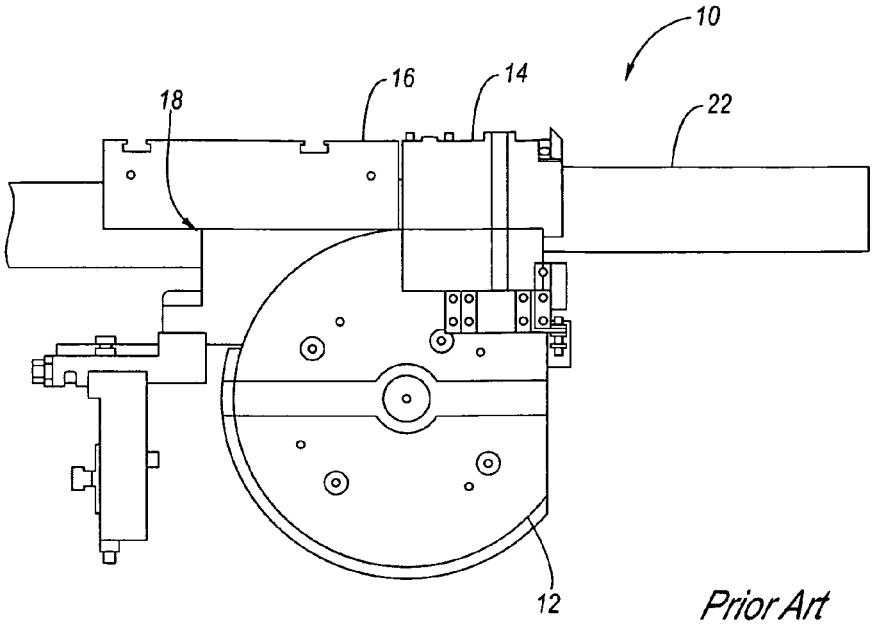
Prior Art Fig. 1
FIG. 1 is a top plan view of a portion of a prior art hydraulic rotary draw bender, showing in particular the dies thereof.

Referring now to the Drawing, FIGS. 6A through 15 depict various aspects of a pressure sensing wiper die insert, and methodology of use therefor, according to the present invention which includes a first set of pressure sensors for indicating normal pressure distribution and a second set of pressure sensors for indicating axial pressure distribution.

The pressure sensing the wiper die 100*a*, 100*b*, 100*a*', 100*b*' according to the present invention (see FIGS. 8 and 12) is composed of a wiper die holder 106 and a wiper die insert 108, which have mutually mating surfaces, a concave holder mating surface 106*a* (see FIGS. 6A and 10A) and a convex insert mating surface 108*a* (see FIG. 6B and FIG. 10B), which mating surfaces are complementing with respect to each other, and wherein one or the other mating surface has disposed thereat a first set of pressure sensors 102, as will be discussed in detail hereinbelow. Further, at an axial abutment 118, 118' as between the wiper die holder 106 and the wiper die insert 108 is disposed a second set of pressure sensors 104, as will also be discussed in detail hereinbelow.

Figure 2:
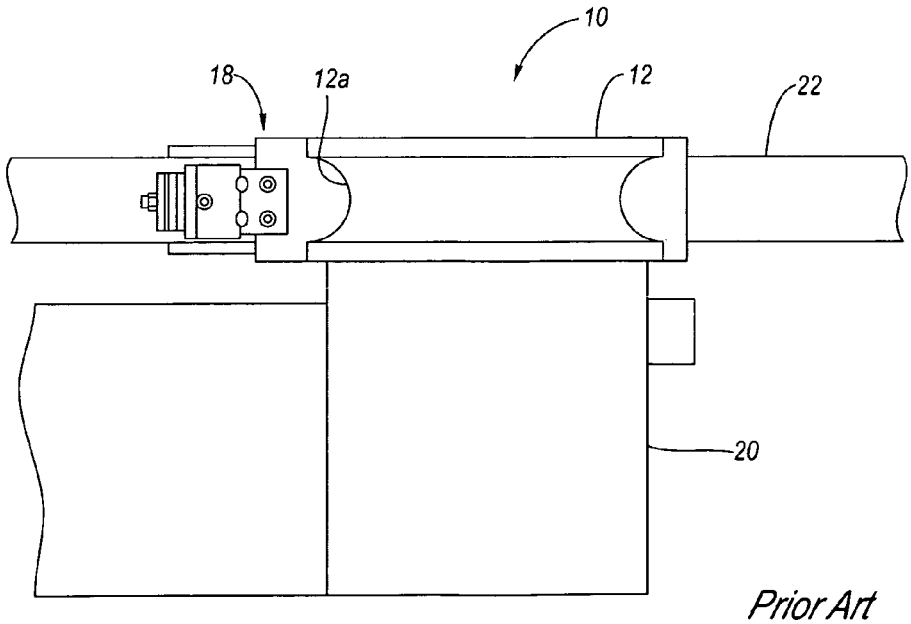
Prior Art Fig. 2
FIG. 2 is a side view of the prior art hydraulic rotary draw bender of FIG. 1.
Figure 3:
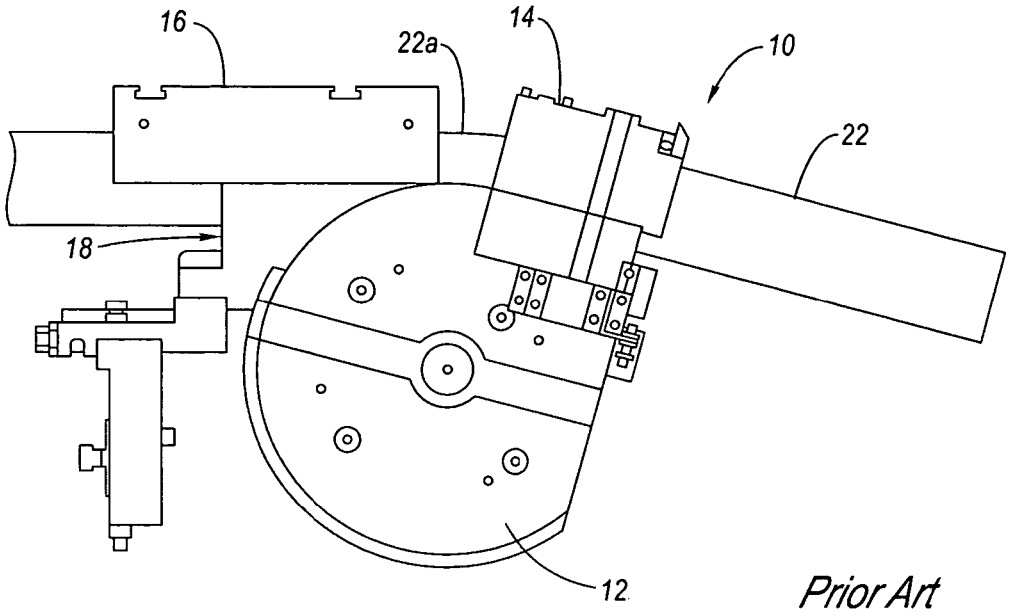
Prior Art Fig. 3
FIG. 3 is a top plan view of a portion of a prior art hydraulic rotary draw bender of FIG. 1, showing a tubular workpiece being bent thereby.
Figure 4:
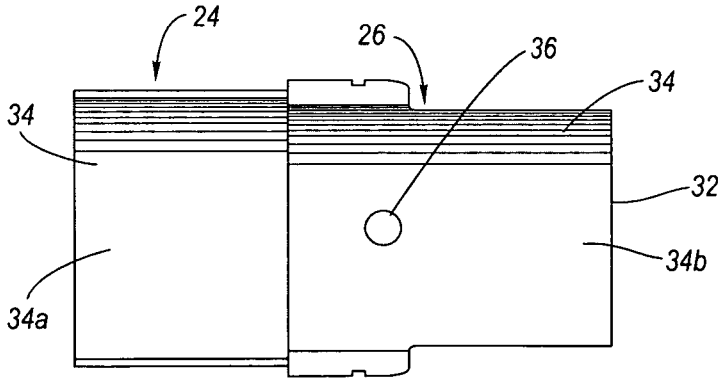
Prior Art Fig. 4
FIG. 4 is a top plan view of an example of a prior art wiper die as used in the prior art bender of FIG. 1.
Figure 5A:
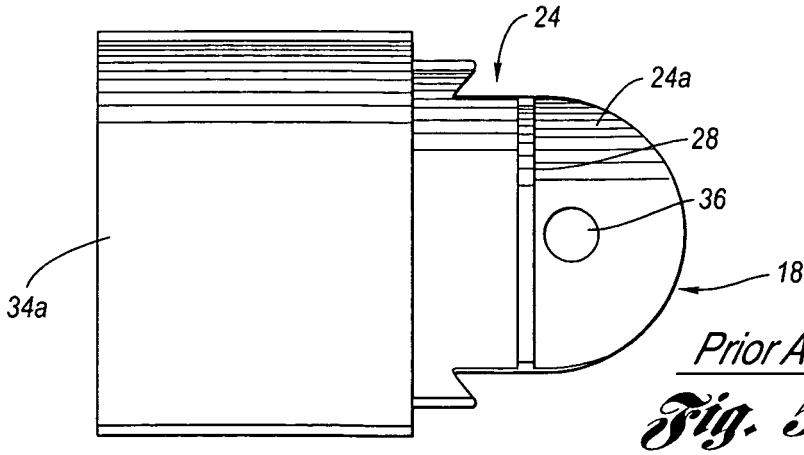
Prior Art Fig. 5A
FIG. 5A is a top plan view of a wiper die holder of the prior art wiper die of FIG. 4.
Figure 5B:
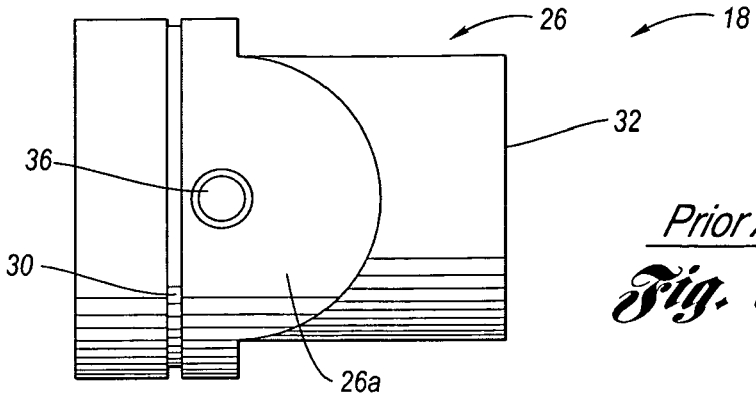
Prior Art Fig. 5B
FIG. 5B is a bottom plan view of a wiper die insert of the prior art wiper die of FIG. 4.

The holder mating surface 106*a* has a raised boss 110 which is received by a complementary keyway (i.e., slot) 112 formed in the insert mating surface 108*a*. The pressure sensing wiper die 100*a*, 100*b*, 100*a*', 100*b*' has a workpiece seating surface 114 having a concave radius for seating the convex outer surface of a tubular workpiece (as for example workpiece 22), wherein, in this respect, the wiper die holder 106 has a holder workpiece seating surface 114*a*, and the wiper die insert 108 has an insert workpiece seating surface 114*b*. At the distal end of the insert workpiece seating surface 114*b* is an insert edge 116 which, as mentioned hereinabove, is of critical importance in the quality of the bend of the workpiece, via careful adjustment of the interface of the insert edge 116 with respect to each of the bend die (see 12 in FIGS. 1 through 3) and the workpiece. By way of example, the wiper die insert 108 is affixed to the wiper die holder 106 via, for example, a threaded fastener (not shown) threading at a bore 126 in the wiper die holder and the wiper die insert, wherein the bore is threaded at the wiper die insert portion thereof, however, the affixment may be by another mechanically suitable means.

It is to be understood that the pressure sensors used for the first and second sets of pressure sensors 102, 104 may be any suitable form of pressure sensors, wherein merely by way of example FIGS. 6A through 9B depict the first and second sets of pressure sensors in the form of a plurality of strain gauges 124, and wherein merely by way of example FIGS. 10A through 13B depict the first and second sets of pressure sensors in the form of a plurality of tactile pressure sensors 124', wherein the tactile pressure sensors are most preferred. Further, the first set of pressure sensors 102 is normally disposed and the second set of pressure sensors 104 is axially disposed, wherein by "axially disposed" is meant disposed at a surface in which abutment is along axis A (see FIGS. 9 and 12), and by "normally disposed" is meant at a surface in which abutment is normal to the axis A.

Figure 6A:
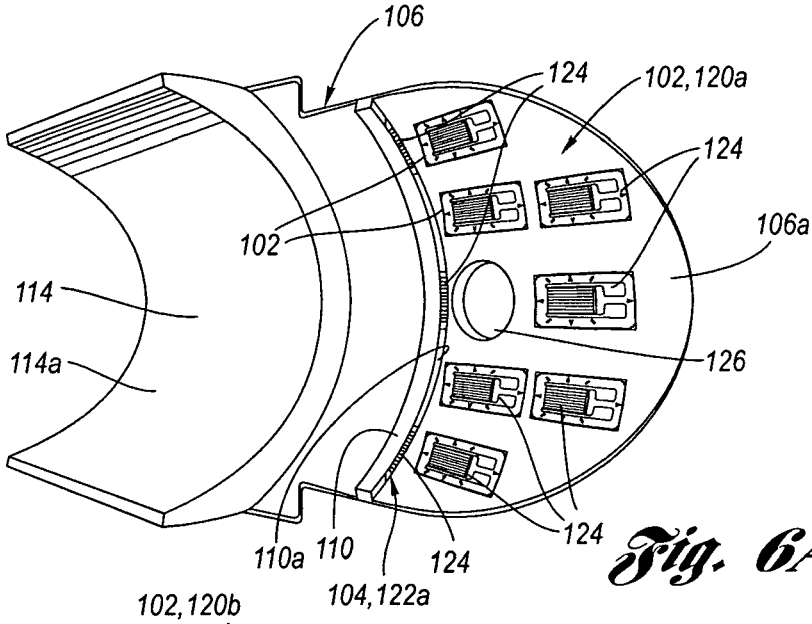
FIG. 6A is a top perspective view of a wiper die holder having a plurality of pressure sensors, shown by example as strain gauges, in accordance with the present invention.

As shown at FIG. 6A, the embodiment of the pressure sensing wiper die 100*a* (of FIG. 8) has the holder mating surface 106*a* of the wiper die holder 106 including a normally disposed first set of pressure sensors 120*a* and an axially disposed second set of pressure sensors 122*a*. Each of the pressure sensors is a strain gauge 124, which is commercially available, for example through Omega Engineering, Inc. of Stamford, Conn. 06907.

Figure 7A:
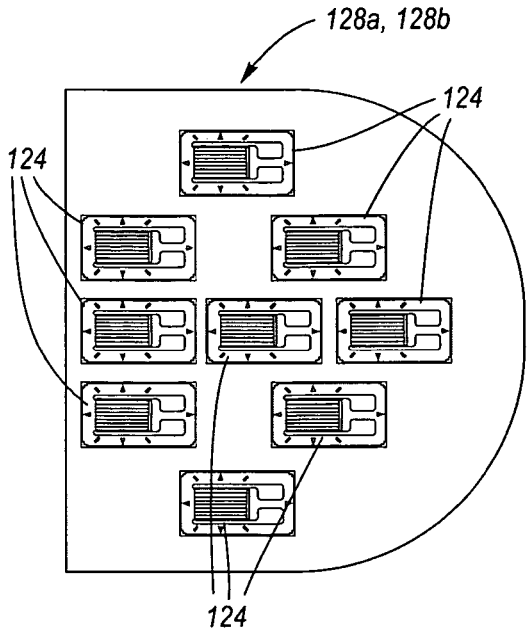
FIG. 7A is an example of a first set of pressure sensors in the form of a first flexible circuit of strain gauges for measuring normal pressure distribution between the wiper die insert and wiper die holder mating surfaces.
Figure 9A:
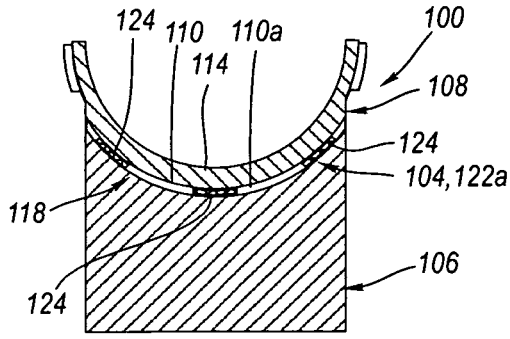
FIG. 9A is a sectional view along line 9A-9A of FIG. 8, showing in particular the second set of pressure sensors disposed at the boss of a wiper die holder in accordance with the present invention.
Figure 9B:
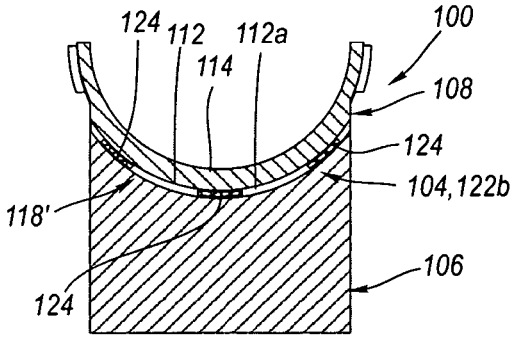
FIG. 9B is a sectional view along line 9B-9B of FIG. 8, showing in particular the second set of pressure sensors disposed at the keyway of a wiper die insert in accordance with the present invention.
Figure 9C:
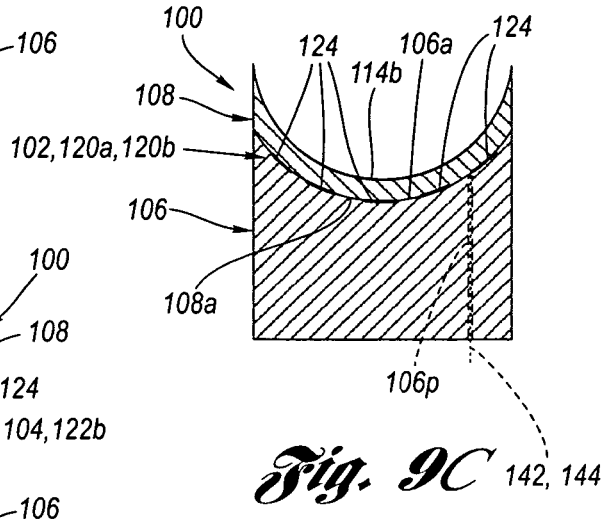
FIG. 9C is a sectional view along line 9C-9C of FIG. 8, showing in particular the first set of pressure sensors disposed between the mating surfaces of the wiper die holder and wiper die insert in accordance with the present invention.

At FIG. 6A, the first set of pressure sensors 120*a* is placed on the holder mating surface 106*a* of the wiper die holder 106 so as to be in pressing abutment with the complementing insert mating surface 108*a* of the wiper die insert 108 (see FIG. 9C). The strain gauges 124 of the first set of pressure sensors 120*a* are distributed so as to register pressures at strategic locations of the normally abutting interface between the wiper die insert and the wiper die holder mating surfaces, whereby the operator is enabled to evaluate the normal forces acting on the wiper die insert and rake angle of the wiper die insert during bending operations. By way of example, a flexible circuit of strain gauges 128*a*, as shown at FIG. 7A, may be affixed, such as by an adhesive, to the holder mating surface for this purpose, wherein the flexible circuit is formed, for example, according to techniques well known in the art, wherein for example Omega Engineering, Inc. makes a product by etching constatan foil, which is then completely sealed in a carrier medium composed of polyimide film. Electrical leads (not shown for clarity) are attached to each strain gauge 124 and connect with an external electrical circuit (i.e., CPU 146 of FIG. 14).

Figure 7B:
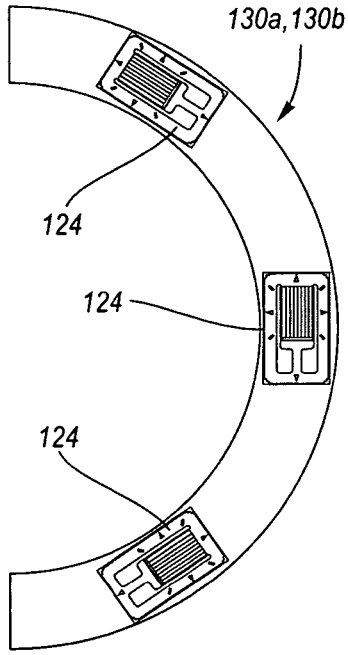
FIG. 7B is an example of a second set of pressure sensors in the form of a second flexible circuit of strain gauges for measuring axial pressure distribution between the wiper die insert and wiper die holder.
Figure 8:
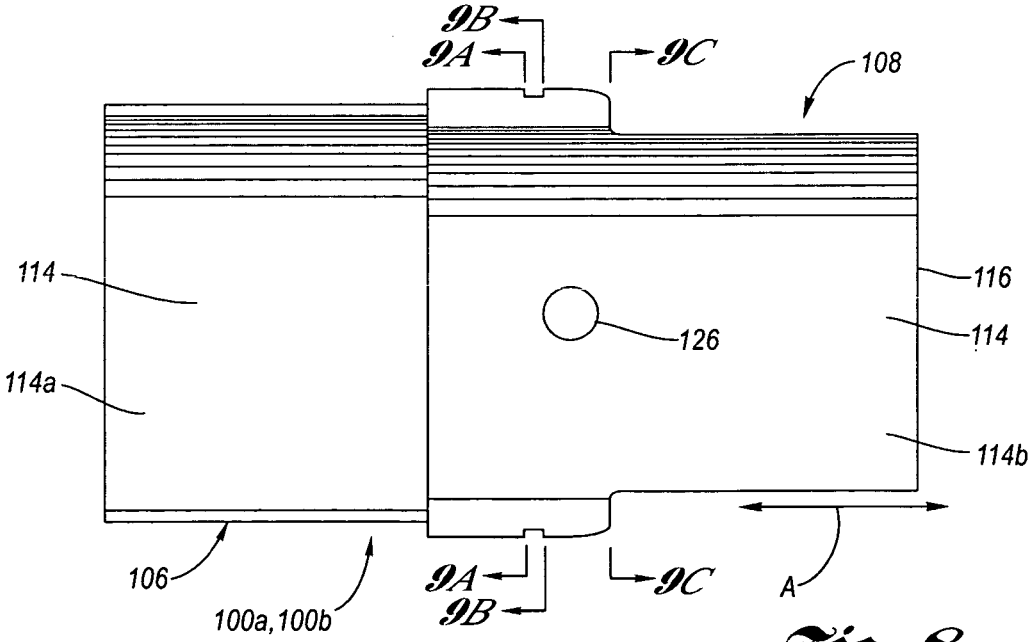
FIG. 8 is a top plan view of a pressure sensing wiper die having pressure sensors in the form of strain gauges according to the present invention.

Further at FIG. 6A, the second set of pressure sensors 122*a* is placed at an axially disposed abutment surface, preferably the abutment surface 110*a* of the boss 110, such that the abutment surface is at the axial abutment 118 between the wiper die insert and the wiper die holder (see FIG. 9B). The strain gauges 124 of the second set of pressure sensors 122*a* are distributed so as to register pressures at strategic locations of the axially abutting interface between the wiper die insert and the wiper die holder axial surfaces, whereby the operator is enabled to evaluate the axial forces acting on the wiper die insert and the fore-aft location of the wiper die insert during bending operations. By way of example, a flexible circuit of strain gauges 130*a*, as shown at FIG. 7B, may be affixed, such as by adhesive, to the boss for this purpose, wherein the flexible circuit is formed, for example, according to techniques well known in the art. Electrical leads (not shown for clarity) are attached to each strain gauge 124 and connect with an external electrical circuit (i.e., CPU 146 of FIG. 14).

Figure 6B:
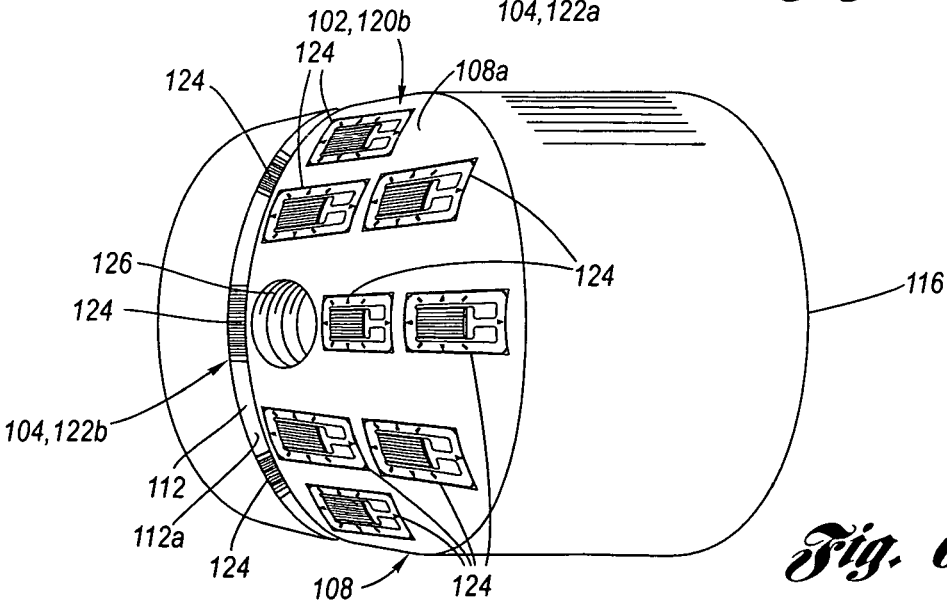
FIG. 6B is a bottom perspective view of a wiper die insert having a plurality of pressure sensors, shown by example as strain gauges, in accordance with the present invention.

As shown at FIG. 6B, the embodiment of the pressure sensing wiper die 100*b* (see again FIG. 8) has the insert mating surface 108*a* of the wiper die insert 108 including a normally disposed first set of pressure sensors 120*b* and an axially disposed second set of pressure sensors 122*b*. Each of the pressure sensors is a strain gauge 124, being commercially available as described above.

At FIG. 6B, the first set of pressure sensors 120*b* is placed on the insert mating surface 108*a* of the wiper die insert 108 so as to be in pressing abutment with the complementing holder mating surface 106*a* of the wiper die holder 106 (see FIG. 9C). The strain gauges 124 of the first set of pressure sensors 120*b* are distributed so as to register pressures at strategic locations of the normally abutting interface between the wiper die insert and the wiper die holder mating surfaces, whereby the operator is enabled to evaluate the normal forces acting on the wiper die insert and the rake angle of the wiper die insert during bending operations. By way of example, a flexible circuit of strain gauges 128*b*, as shown at FIG. 7A, may be affixed, such as by an adhesive, to the insert mating surface for this purpose, as discussed above. Electrical leads (not shown for clarity) are attached to each strain gauge 124 and connect with an external electrical circuit (i.e., CPU 146 of FIG. 14).

Further at FIG. 6B, the second set of pressure sensors 122*b* is placed at an axially disposed abutment surface, preferably being the abutment surface 112*a* of the keyway 112, such that the abutment surface is at the axial abutment 118' between the wiper die insert and the wiper die holder (see FIG. 9A). The strain gauges 124 of the second set of pressure sensors 122*b* are distributed so as to register pressures at strategic locations of the abutting interface between the wiper die insert and the wiper die holder axial surfaces, whereby the operator is enabled to evaluate the axial forces acting on the wiper die insert and the fore-aft location of the wiper die insert during bending operations. By way of example, a flexible circuit of strain gauge sensors 130*b*, as shown at FIG. 7B, may be affixed, such as by an adhesive, to the keyway for this purpose, as discussed above. Electrical leads (not shown for clarity) are attached to each strain gauge 124 and connect with an external electrical circuit (i.e., CPU 146 of FIG. 14).

Figure 10A:
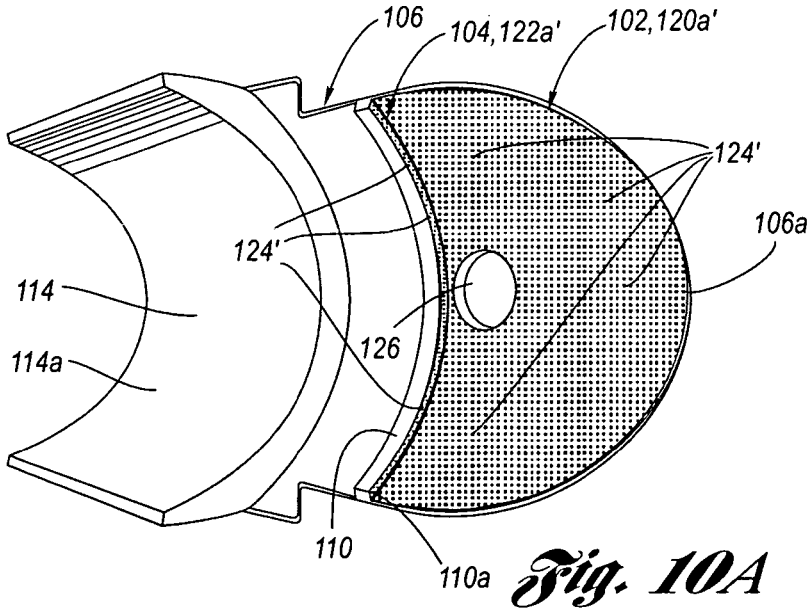
FIG. 10A is a top perspective view of a wiper die holder having a plurality of pressure sensors, shown by example as tactile pressure sensors, in accordance with the present invention.

As shown at FIG. 10A, the embodiment of the pressure sensing wiper die 100*a*' (of FIG. 12) has the holder mating surface 106*a* of the wiper die holder 106 including a normally disposed first set of pressure sensors 120*a*' and an axially disposed second set of pressure sensors 122*a*'. Each of the pressure sensors is a tactile pressure sensor 124', which is commercially available, and example being the Tactilus® matrix-based tactile surface sensor and force indicating washer products of Sensor Products, Inc. of Madison, N.J. 07940, which are essentially an "electronic skin" that records and interprets pressure distribution and magnitude between any two contacting or mating surfaces and assimilates that data collected into a powerful Windows® based tool kit (for example being resident at Block 146 of FIG. 14), and the Tactilus® force indicating washer measures and assesses bolted joint tension, which, unlike traditional strain gauged load cells and force washers, the Tactilus® force sensor is extremely thin, wherein the Tactilus® force indicating washer reveals precisely how much force (tensile load) is being applied at the interface of the bolt and flange surface and how this force is circumferentially distributed.

Figure 11A:
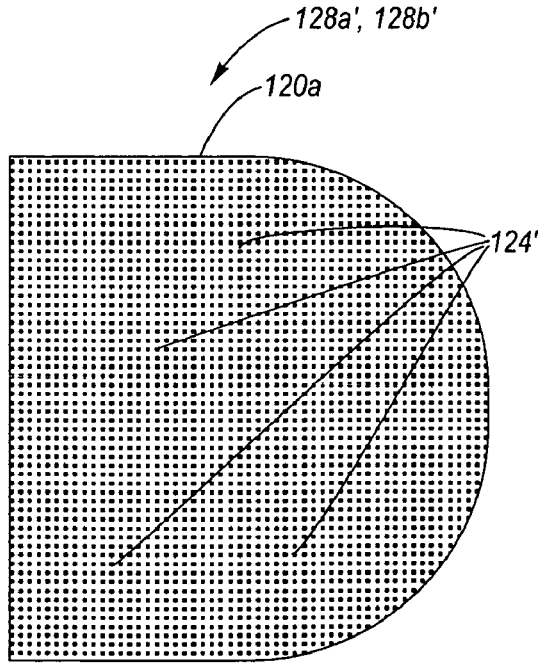
FIG. 11A is an example of a first set of pressure sensors in the form of a first flexible circuit of tactile pressure sensors for measuring normal pressure distribution between the wiper die insert and wiper die holder mating surfaces.
Figure 13A:
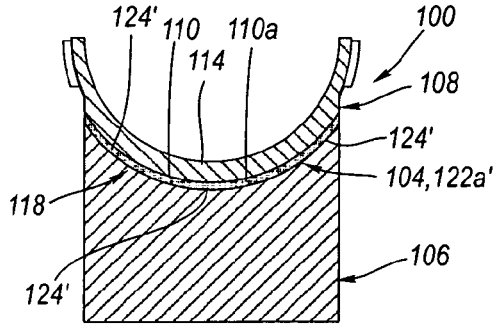
FIG. 13A is a sectional view along line 13A-13A of FIG. 11, showing in particular the second set of pressure sensors disposed at the boss of a wiper die holder in accordance with the present invention.
Figure 13C:
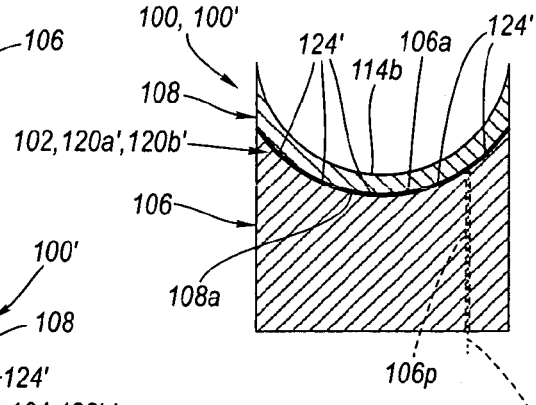
FIG. 13C is a sectional view along line 13C-13C of FIG. 11, showing in particular the first set of pressure sensors disposed between the mating surfaces of the wiper die holder and wiper die insert in accordance with the present invention.

At FIG. 10A, the first set of pressure sensors 120*a*' is placed on the holder mating surface 106*a* of the wiper die holder 106 so as to be in pressing abutment with the complementing insert mating surface 108*a* of the wiper die insert 108 (see FIG. 13C). The tactile pressure sensors 124' of the first set of pressure sensors 120*a*' are distributed so as to register pressures at strategic locations of the normally abutting interface between the wiper die insert and the wiper die holder mating surfaces, whereby the operator is enabled to evaluate the normal forces acting on the wiper die insert and the rake angle of the wiper die insert during bending operations. By way of example, a matrix of tactile pressure sensors 128*a*', as for example having hundreds or thousands of tactile pressure sensors, as shown at FIG. 11A, may be affixed, such as by an adhesive, to the holder mating surface for this purpose, wherein the matrix is formed, for example, according to techniques well known in the art, and electrically connect with an external electrical circuit (i.e., CPU 146 of FIG. 14).

Figure 11B:
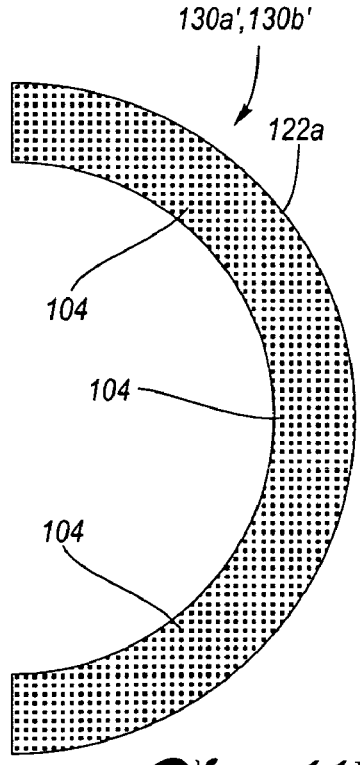
FIG. 11B is an example of a second set of pressure sensors in the form of a second flexible circuit of tactile pressure sensors for measuring axial pressure distribution between the wiper die insert and wiper die holder.
Figure 12:
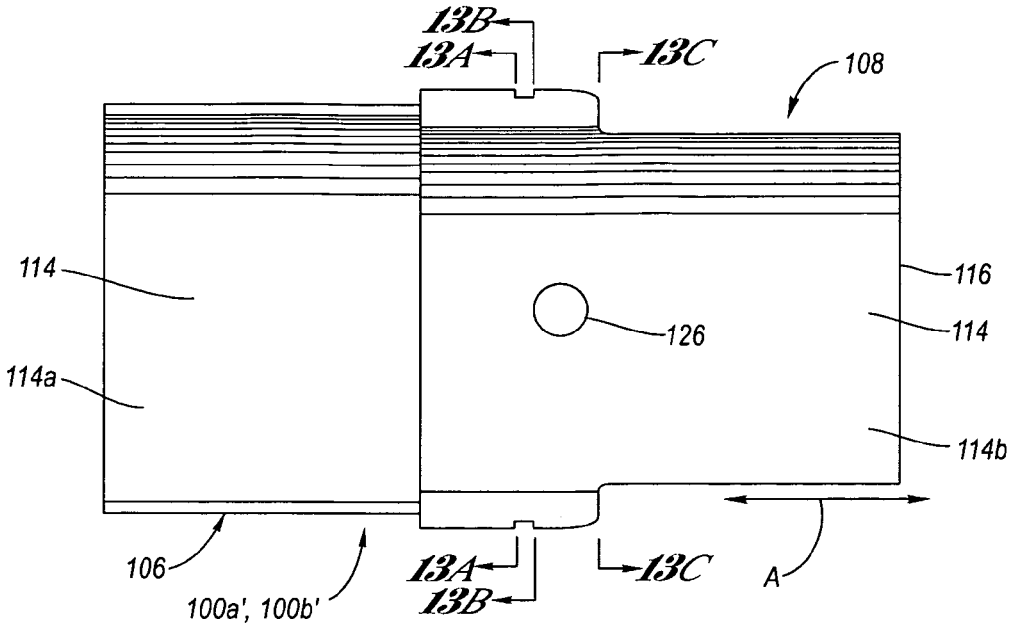
FIG. 12 is a top plan view of a pressure sensing wiper die having pressure sensors in the form of tactile pressure sensors according to the present invention.
Figure 13B:
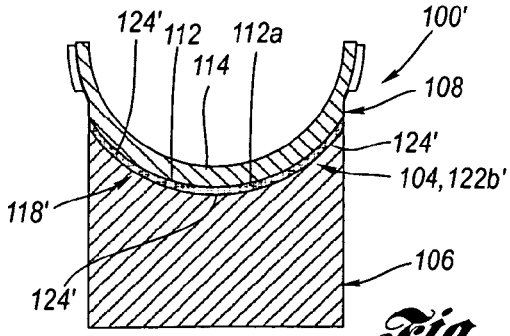
FIG. 13B is a sectional view along line 13B-13B of FIG. 11, showing in particular the second set of pressure sensors disposed at the keyway of a wiper die insert in accordance with the present invention.

Further at FIG. 10A, the second set of pressure sensors 122*a*' is placed at an axially disposed abutment surface, preferably the abutment surface 110*a* of the boss 110, such that the abutment surface is at the axial abutment 118 between the wiper die insert and the wiper die holder (see FIG. 13B). The tactile pressure sensors 124' of the second set of pressure sensors 122*a*' are distributed so as to register pressures at strategic locations of the axially abutting interface between the wiper die insert and the wiper die holder axial surfaces, whereby the operator is enabled to evaluate the axial forces acting on the wiper die insert and the fore-aft location of the wiper die insert during bending operations. By way of example, a matrix of tactile pressure sensors 130*a*', as shown at FIG. 11B, may be affixed, such as by adhesive, to the boss for this purpose, wherein the matrix is formed, for example, according to techniques well known in the art. Electrical leads connect with an external electrical circuit (i.e., CPU 146 of FIG. 14).

Figure 10B:
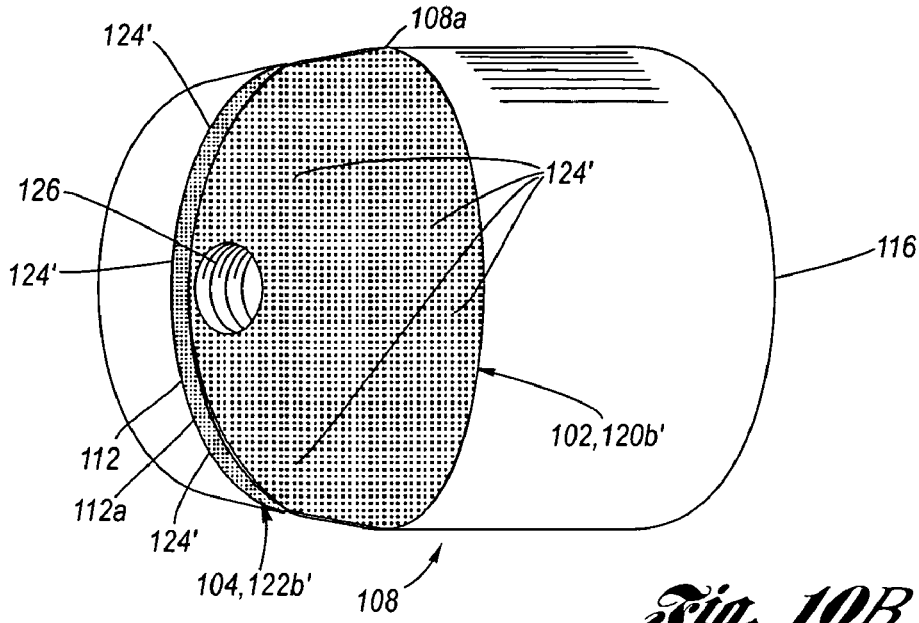
FIG. 10B is a bottom perspective view of a wiper die insert having a plurality of pressure sensors, shown by example as tactile pressure sensors, in accordance with the present invention.

As shown at FIG. 10B, the embodiment of the pressure sensing wiper die 100*b*' (see again FIG. 12) has the insert mating surface 108*a* of the wiper die insert 108 including a normally disposed first set of pressure sensors 120*b*' and an axially disposed second set of pressure sensors 122*b*'. Each of the pressure sensors is a tactile pressure sensor 124', being commercially available as described above.

At FIG. 10B, the first set of pressure sensors 120*b*' is placed on the insert mating surface 108*a* of the wiper die insert 108 so as to be in pressing abutment with the complementing holder mating surface 106*a* of the wiper die holder 106 (see FIG. 13C). The tactile pressure sensors 124' of the first set of pressure sensors 120*b*' are distributed so as to register pressures at strategic locations of the normally abutting interface between the wiper die insert and the wiper die holder mating surfaces, whereby the operator is enabled to evaluate the normal forces acting on the wiper die insert and the rake angle of the wiper die insert during bending operations. By way of example, a matrix of tactile pressure sensors 128*b*', as shown at FIG. 11A, may be affixed, such as by an adhesive, to the insert mating surface for this purpose, as discussed above. Electrical leads connect with an external electrical circuit (i.e., CPU 146 of FIG. 14).

Further at FIG. 10B, the second set of pressure sensors 122*b*' is placed at an axially disposed abutment surface, preferably the abutment surface 112*a* of the keyway 112, such that the abutment surface is at the axial abutment 118' between the wiper die insert and the wiper die holder (see FIG. 13A). The tactile pressure sensors 124' of the second set of pressure sensors 122*b*' are distributed so as to register pressures at strategic locations of the abutting interface between the wiper die insert and the wiper die holder axial surfaces, whereby the operator is enabled to evaluate the axial forces acting on the wiper die insert and the fore-aft location of the wiper die insert during bending operations. By way of example, a matrix of tactile pressure sensors 130*b*', as shown at FIG. 11B, may be affixed, such as by an adhesive, to the keyway for this purpose, as discussed above. Electrical leads connect with an external electrical circuit (i.e., CPU 146 of FIG. 14).

An advantage of placing the first and second sets of pressure sensors on the wiper die holder is that this is a component not subject to the wear out replacement rate of the wiper die, whereby the costs associated with replacement of the pressure sensors is minimized. On the other hand, while the placement of the first and second sets of pressure sensors on the wiper die insert may be more costly due to a more rapid replacement, the sensors may detect stresses and strains in the wiper die insert which, for example under empirical or other analytical evaluation, may yield information of the operative characteristics of the wiper die insert vis-à-vis its ability to produce bent tubular workpieces of desired quality.

Figure 14:
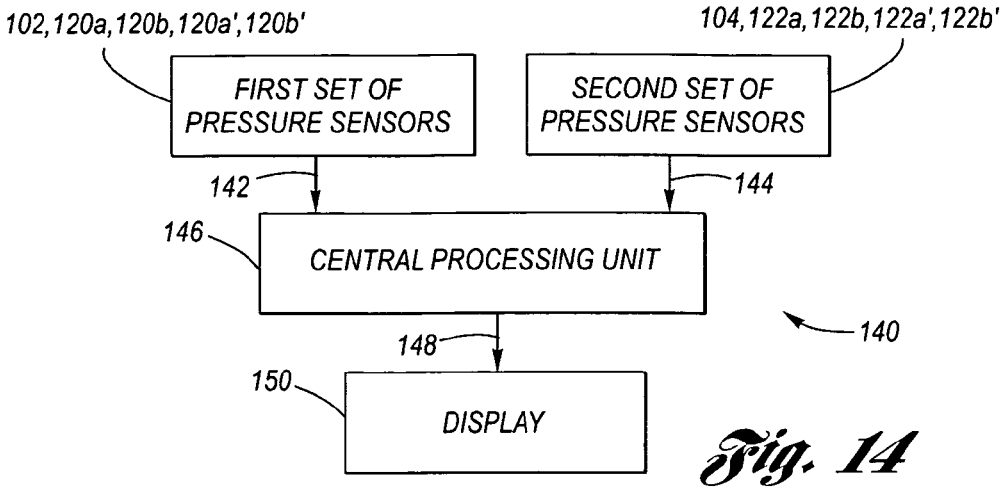
FIG. 14 is an example of an electronic components diagram according to the present invention.
Figure 15:
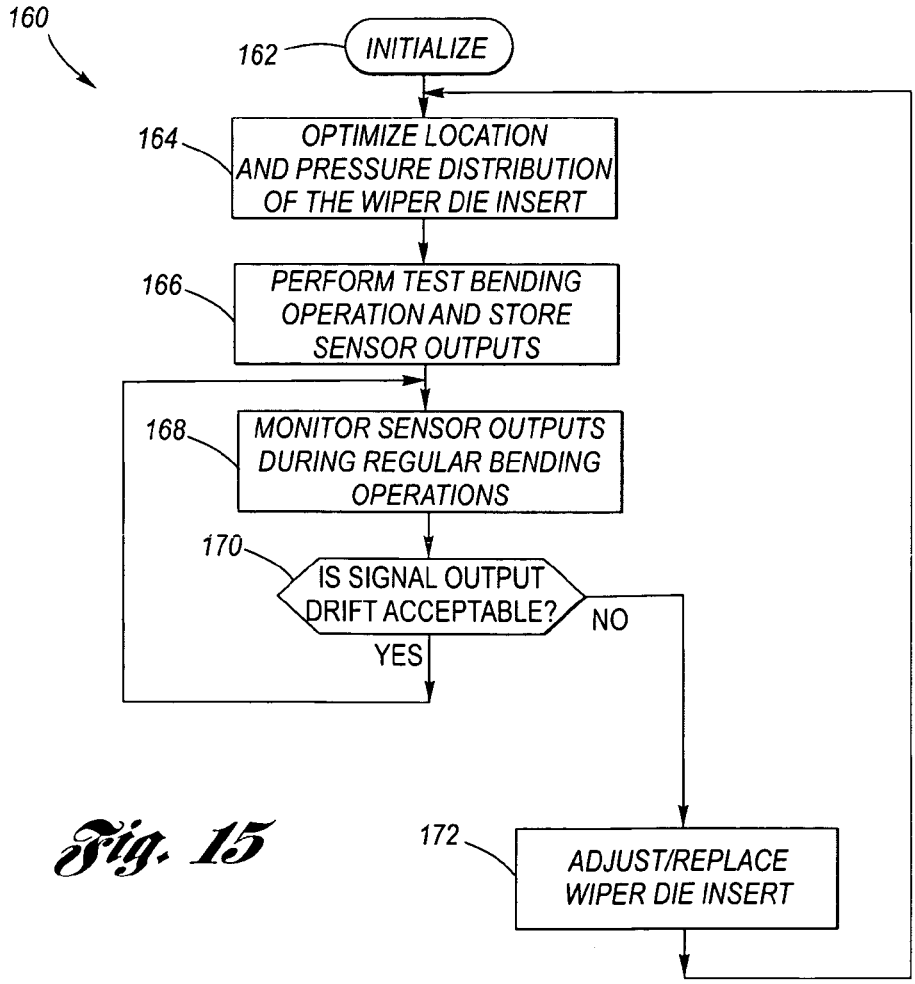
FIG. 15 is an example of an algorithm for carrying out the methodology of the present invention.

Referring now additionally to FIGS. 14 and 15 the wiper die insert monitoring apparatus and methodology according to the present invention will be further detailed.

As shown at FIG. 14, an electrical circuit 140 includes the first set of pressure sensors 102, 120*a*, 120*b*, 120*a*', 120*b*' and the second set of pressure sensors 104, 122*a*, 122*b*, 122*a*', 122*b*', which are electrically connected with an electronic central processing unit (CPU) 146, having an internal signal output storage capability and internal programming to process signal output data of the pressure sensors. It is understood that the various pressure sensors (be they tactile pressure sensors 124', strain gauges 124 or of another type) of the first and second sets of pressure sensors would be, respectively, mutually electrically connected 142, 144 in a conventional manner to the CPU, as for example via wiring passing through a passageway 106*p* (shown in phantom at FIGS. 9C and 13C) through the wiper die holder. The electrical connection between the pressure sensors and the CPU may be wired or wireless. The CPU 146 has a data line 148 to a display device 150, as for example an electronically driven LCD screen, wherein stored output signals and current output signals are provided to the display for comparative viewing as selectively formatted by the CPU 146.

Turning attention next to FIG. 15, an algorithm 160 for carrying out the monitoring methodology according to the present invention is depicted by way of exemplification. At Block 162, the algorithm is initialized and moves to Block 164, whereat the wiper die insert 108 is affixed to the wiper die holder and the wiper die is located so that the wiper die insert has an optimized rake angle and for-aft location, as well as optimized normal pressure distribution when performing a bending operation on a tubular workpiece. Traditional execution of Block 164 involves a manual alignment procedure for optimal location of the wiper die insert utilizing a tube the same or similar to the tubular workpiece to be bent. The tube is inserted into the horizontal rotary draw bender and then clamped by the clamp and pressure dies and any adjustment is manually made by a trained operator. Once the location adjustments to the wiper die have been made, a tubular workpiece is bent to verify that the set-up is correct. This may require iteration of trial-and-error episodes, as well as removal and replacement of the wiper die insert should this become damaged during the manual location set-up, wherein the algorithm then moves on to Block 166.

At Block 166, nominal signal outputs for each of the first and second sets of pressure sensors are provided by test bending operations, which signal outputs are stored in the CPU. A tubular workpiece is bent and the normal and axial pressures (strains) exerted on the wiper die are recorded at the CPU 146, and the quality of the bent tube is observed and recorded. This process repeats itself several times and each time with different values for any of the wiper die insert rake angle, fore/aft location and/or the normal pressure distribution. Following this iterative process for multiple tooling configurations, an operating window is established wherein average nominal output signal values are provided and stored in the CPU. Multiple operating windows may also be established based on tube material properties, lubrication, tube coatings, tube thickness, tube diameter, clamp die configuration, bend die diameter, etc, each being recorded in the CPU as a nominal profile which can be called-up by the operator. Once an operating window has been established, the nominal output signal values are used to correctly set-up the dies in order to make a good quality bend by using the strain profiles, knowledge and experience. This operating window should yield a set-up sweet spot which will provide for the longest tool life, best quality and reduce equipment stress for an overall gain in productivity at reduced downtime and cost. This information can now be incorporated into the bender controller and used as a wiper die monitor for production purposes (i.e., provide a set of nominal output signal values for monitoring). Indeed, a step function can be developed that will allow incremental adjustments to the dies during production runs that will allow for the maximum wiper die life, improved bend quality and increased productivity.

Thereafter, at Block 168, in the course of operation of the horizontal rotary draw bender, the signal outputs from the first and second sets of pressure sensors are compared to the stored nominal signal outputs, as for example by an operator observing the display device 150. Next, at Decision Block 170, inquiry is made as to whether the current output signals are within a predetermined amount of acceptable drift with respect to nominal output signals via the operator making a comparative viewing or by an electronic data analysis subroutine of the CPU. If the answer to the inquiry is yes, the algorithm loops back to Block 168, whereat monitoring of bending operations continues. However, if the answer to the inquiry is no, then the algorithm advances to Block 172, whereat the wiper die insert is considered to be in a condition of unacceptability to make quality bent tubular articles in the horizontal rotary draw bender, whereby corrective action is taken by the operator, as for example by realignment or replacement of the wiper die insert. Thereafter, the algorithm returns to Block 162.

A further exemplification of the execution of Blocks 168 through 172 is as follows. If during a bending operation, the first set of pressure sensors nearest or farthest from the insert edge have an output signal change (drift) from the nominal output signals (above a predetermined acceptable range), then the operator is enabled to evaluate whether the insert edge is improperly mating to the concave radius of the bend die due to an improper rake angle, requiring correction. If during a bending operation, the first set of pressure sensors have an output signal change (drift) from the nominal output signals (above a predetermined acceptable range), then the operator is enabled to evaluate whether the wiper die insert has an improper normal force acting upon it, requiring correction. If during a bending operation, the second set of pressure sensors have an output signal change (drift) from the nominal output signals (above a predetermined acceptable range), then the operator is enabled to evaluate whether the wiper die insert fore-aft location may be improper, requiring correction. If during a bending operation, the first and/or second set of pressure sensors have an output signal change (drift) from the nominal output signals (above a predetermined acceptable range), then the operator is enabled to evaluate whether the wipe friction of the workpiece relative to the insert workpiece seating surface has become too low or too high, requiring correction.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. An apparatus for wiper die monitoring during a bending operation performed on a tubular workpiece, comprising:

a pressure sensitive wiper die, comprising:

a wiper die holder having a holder mating surface and an oppositely disposed holder workpiece seating surface;

a wiper die insert having an insert mating surface and an oppositely disposed insert workpiece seating surface, said insert mating surface complementing said holder mating surface, said wiper die insert being heldably located by said wiper die holder such that said insert mating surface normally abuts said holder mating surface, an axial abutment being disposed between said wiper die insert and said wiper die holder;

a first set of pressure sensors disposed at the normal abutment of said wiper die insert with respect to said wiper die holder; and a second set of pressure sensors disposed at the axial abutment of said wiper die insert with respect to said wiper die holder.

2. The apparatus of claim 1, wherein:

said first set of pressure sensors is affixed to and distributed upon the holder mating surface; and said second set of pressure sensors is affixed to and distributed upon the wiper die holder at the axial abutment.

3. The apparatus of claim 2, wherein said axial abutment comprises:

a keyway formed in said insert mating surface; and a boss formed on said holder mating surface;

wherein the boss is in axial abutment with said keyway when said insert mating surface is abutting with respect to said holder mating surface; and wherein said second set of pressure sensors is affixed to and distributed upon said boss.

4. The apparatus of claim 3, further comprising an electronic display electrically connected with said first and second sets of pressure sensors, wherein said display displays signal outputs of the first and second sets of pressure sensors.

5. The apparatus of claim 4, further comprising a passageway formed in said wiper die holder wherethrough wiring connected to said first and second sets of pressure sensors passes.

6. The apparatus of claim 1, wherein:

said first set of pressure sensors is affixed to and distributed upon the insert mating surface; and said second set of pressure sensors is affixed to and distributed upon the wiper die insert at the axial abutment.

7. The apparatus of claim 6, wherein said axial abutment comprises:

a keyway formed in said insert mating surface; and a boss formed on said holder mating surface;

wherein the boss is in axial abutment with said keyway when said insert mating surface is abutting with respect to said holder mating surface; and wherein said second set of pressure sensors is affixed to and distributed upon said keyway.

8. The apparatus of claim 7, further comprising an electronic display electrically connected with said first and second sets of pressure sensors, wherein said display displays signal outputs of the first and second sets of pressure sensors.

9. The apparatus of claim 8, further comprising a passageway formed in said wiper die holder wherethrough wiring connected to said first and second sets of pressure sensors passes.

10. A method for monitoring a wiper die during a bending operation performed on a tubular workpiece by a rotary tube bender, comprising the steps of:

affixing a wiper die insert of the wiper die to a wiper die holder of the wiper die;

locating the wiper die such that the wiper die insert is operably aligned with respect to a pressure die of the bender, a clamp die of the bender and a bend die of the bender such that during a bending operation, the workpiece is bent having a predetermined bend quality;

monitoring pressure between a normal abutment surface of the wiper die insert with respect to the wiper die holder;

monitoring pressure between an axial abutment surface of the wiper die insert with respect to the wiper die holder; and determining operative characteristics of the wiper die insert during bending operations responsive to said steps of monitoring to determine operational characteristics of the wiper die during each bend operation.

11. The method of claim 10, further comprising the steps of:

performing said steps of monitoring an initial time after said step of locating to thereby provide a nominal set of normal and axial pressure data; and performing said steps of monitoring subsequent to said initial time;

wherein said step of determining comprises comparing the nominal set of normal and axial pressures with normal and axial pressures provided by said steps of monitoring subsequent to said initial time, wherein drift therebetween is indicative of the operational characteristics.

12. The method of claim 11, further comprising monitoring said normal and axial pressure sensors during said step of location to further determine the operable alignment of said wiper die insert.

* * * * *